United States Patent [19]

Marker

[11] 4,006,496

[45] Feb. 8, 1977

[54] SAFETY HELMET

[75] Inventor: Peter O. Marker, La Habra, Calif.

[73] Assignee: Land Tool Company, Wichita, Kans.

[22] Filed: Aug. 13, 1975

[21] Appl. No.: 604,190

[52] U.S. Cl. ..... 2/414

[51] Int. Cl.[2] ..... A42B 3/00

[58] Field of Search ..... 2/2.5, 3 R, 6, 414, 2/415, 425

[56] References Cited

UNITED STATES PATENTS

| | | | |
|---|---|---|---|
| 3,116,490 | 1/1964 | Zbikowski | 2/3 R |
| 3,242,500 | 3/1966 | Derr | 2/3 R |
| 3,245,087 | 4/1966 | Marchello | 2/3 R |
| 3,465,363 | 9/1969 | Raney | 2/3 R |
| 3,500,475 | 3/1970 | Otsuka | 2/3 R |
| 3,609,764 | 10/1971 | Morgan | 2/3 R |
| 3,616,463 | 11/1971 | Theodore et al. | 2/3 R |
| 3,820,163 | 6/1974 | Rappleyea | 2/3 R |

*Primary Examiner*—G. V. Larkin

[57] ABSTRACT

A lightweight safety helmet for use by the operator of a motorcycle, or the like. The helmet meets all present day standards and specifications as well as the more stringent standards and specifications proposed by the construction of a single shell helmet having a dual shock liner system.

6 Claims, 1 Drawing Figure

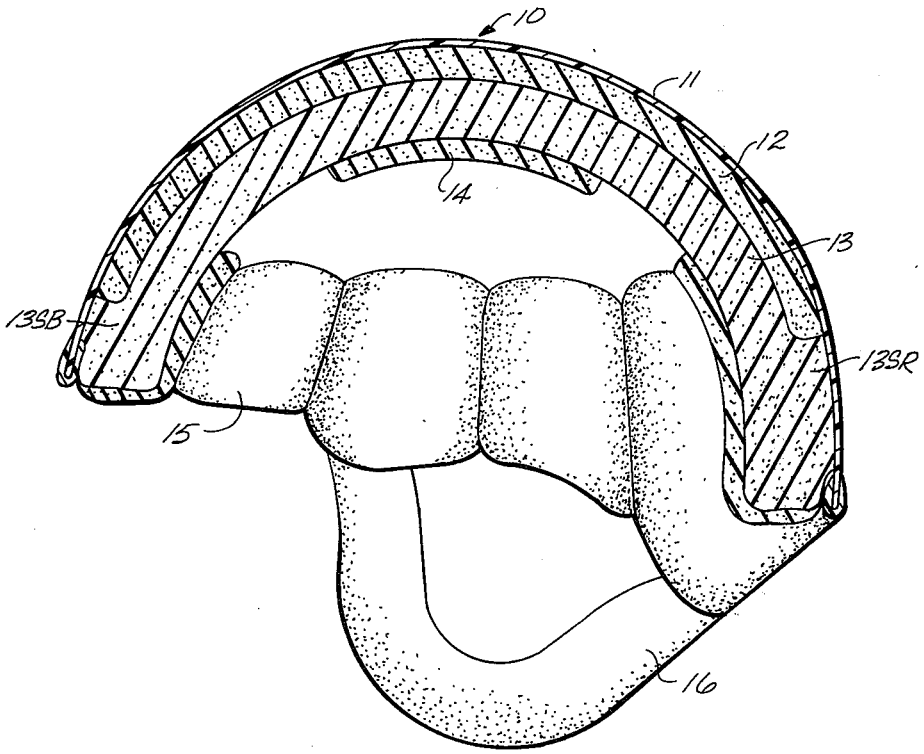
10
11
12
14
13
13BB
13BR
15
16

SAFETY HELMET

DISCLOSURE OF THE INVENTION

This invention relates to a safety helmet and more particularly to a lightweight, safety helmet adapted for use by the operator of a motorcycle, or the like.

The teachings of this invention are based upon the concepts, designs, and improvements in the safety helmet disclosed in my copending patent application bearing Ser. No. 571,793, now abandoned, and assigned to the same assignee as this application.

The structure of the safety helmet disclosed in the above-identified copending patent application meets the specifications and standards that were in existence at the time of the development of that helmet. Since that time further specifications and standards have been proposed that have upgraded and made more demanding the severity of the impact requirements so that the structure embodied in the aforementioned patent application would not meet the requirements of the new standards. In particular, a private testing facility known as the Snell Memorial Foundation of Sacramento, California, has established a 1975 standard with respect to the impact requirements which are more severe than its 1970 standards with regard to increasing drop heights and subsequent impact energy by an average of 20 percent. Similar standards are being considered by the American National Standards Institute and the federal government's Department of Transportation that are essentially equal to the 1975 Snell standards. In evaluating the structure of the safety helmet disclosed in the aforementioned copending patent application relative to the new standards, and in particular the Snell Memorial Foundation standards, it has been established that the two-shell helmet system disclosed in said patent application is partially incapable of dissipating the increased energies required by the new specifications, mainly because of the combined weight of the two shells utilized in that helmet construction thereby raising the levels of the G-forces that result beyond the allowable limits. To meet the new standards requires that a helmet be lighter in weight and have increased stopping distances beyond the helmet disclosed in said application and any other known helmet. Accordingly, at the present time, there is a need for a commercially successful safety helmet for motorcycle operators, or the like, that will be certified by the federal government and the private testing facilities, such as Snell Memorial Foundation that is lightweight and has the proper stopping distances.

The present invention provides an improved, lightweight safety helmet that may be readily constructed from commercially available materials to produce a helmet that is capable of meeting the standards and specifications of all presently known and contemplated governmental and private specifications. The helmet of the present invention is capable of meeting all presently known, or contemplated standards through the production of a safety helmet having a weight on the order of 2½ lbs. and a stopping distance of 1½ inches with a single shell incorporating a dual shock liner system. The helmet will comply with latest standard limits including 300 G's maximum of impact attenuation with 103 foot pounds of energy as required by the Snell Memorial Foundation standards and the two millisecond dwell time at 200 G's standard of the Department of Transportation (D.O.T.)

From a structural standpoint, the safety helmet of the present invention comprises an outer shell shaped to be worn on the head of a user and constructed of a preselected lightweight material having high flexural modulus for distributing the impact load received by the shell. The shell contains a shock absorbing liner of a preselected construction coacting with a resilient shock dampening layer so as to absorb the impact energy transmitted through the outer shell and to release the stored energy after impact without any permanent deformation to either the shock absorbing liner or the shock dampening layer. For this purpose, the shock absorbing layer includes stiffening pads constructed and defined to cover the brow area of the shell when the helmet is worn on the head of the user and extending to the inner wall of the shell. The resilient shock dampening layer is arranged between the inner wall of the shell and the outer surface of the shock absorbing liner and extending coextensively with the inner wall of the shell to the stiffening pads of the shock absorbing liner.

These and other features of the present invention will be more fully appreciated when considered in the light of the following specification and drawing which is a cross sectional view through a midsagittal plane of a safety helmet embodying the present invention.

It should be understood at the outset that the basic concepts involved in the structure of the safety helmet of the present invention are based on the concepts disclosed and employed in the safety helmet disclosed in my copending patent application, Ser. No. 571,793 and which basic concepts, disclosures and teachings are incorporated herein by reference. The teachings of the aforementioned copending application are utilized in the production of a single shell helmet with a dual shock liner system directed to meeting the present day standards and the contemplated standards with regard to weight reduction and increased stopping distances.

Now referring to the drawing, the safety helmet comprising the present invention will be discussed in detail. The safety helmet 10 is constructed of a single outer shell 11 having a dual shock liner system comprising a resilient dampening layer 12 coacting with a shock absorbing liner 13 having stiffening pads integrally constructed therewith and defined and arranged at the brow areas and rear areas of the shell 11 when worn by the user. The brow area stiffening pad is identified in the drawing as 13SB, while the rear area stiffening pad is identified by 13SR. The stiffening pads 13SB and 13SR are constructed integrally with the shock absorbing liner 13 such as by the molding, as is evident from examining the drawing. The resilient shock absorbing layer 12 and the shock absorbing liner 13 coact to absorb the impact energy received by the outer shell 11 and transmitted through the shell and to release the stored energy after impact. The materials selected for the elements 12 and 13 perform this function without any permanent deformation thereof. The outer shell 11 is constructed of a lightweight material having a high flexural modulus for distributing any impact energy impinging thereon.

To satisfy the requirements of the United States Federal Government's Department of Transportation (D.O.T.) and the requirements of the Snell Memorial Foundation that presently exist as well as the standards that are contemplated in the very near future and any other known standards, the helmet shell 11 must have physical properties that exhibit a high flexural modulus, be lightweight and have a chemical resistant finish. The weight of the material selected for the shell 11 should have a maximum weight of 800 grams and a thickness in the range of 0.090 – 0.130 inch. The material should be capable of distributing any impact loads impinging thereon and encapsulate the energy absorbing elements arranged within the shell and be resistant to penetration and tear. A material that can be employed for this purpose that falls within the thickness range mentioned above is a reinforced polyester fiber glass plastic material that is commercially available.

The shock dampening layer 12 should be selected in accordance with the teachings of the present invention to have physical properties that allow it to function as a viscous dampening element, be structurally stable and have a maximum recovery and a minimum temperature sensitivity. A fine-celled flexible foam having a thickness on the order of one-half inch constructed of a cross-linked polyethylene foam material having a density on the order of 1.5 to 2.4 pounds per cubic foot that is commercially available has been successfully employed for this element. The use of such a commercially available fine-celled flexible foam material as the resilient shock dampening layer 12 will function to dampen any transmitted shock energy, lower the rebound velocity and increase the stopping distances normally exhibited by prior art helmets while maintaining the majority of the stopping distance during multiple helmet impacts.

The shock liner 13 functions to absorb the residual energy transmitted through the shell 11 and the shock dampening element 12. The liner 13 should include reinforcing or stiffening elements such as the elements 13SB and 13SR to meet the new standards proposed by the Snell Memorial Foundation with regard to the hemispherical anvil drop tests. The material selected as the shock absorbing liner 13 is preferably a closed-cell foam construction having the maximum resiliency possible, be lightweight and have a density of approximately 2 to 3 pounds per cubic foot, be structurally stable and have a minimum temperature sensitivity. An expandible polystyrene material having a thickness on the order of one inch with the integral stiffening pads having an additional thickness of approximately one-half inch at the stiffening areas 13SB and 13SR has been successfully employed. The stiffening pads may be further defined so that the brow area pad 13SB is approximately 1.25 inches in width, while the rear stiffening pad 13SR has a width on the order of 2 inches. The pads 13SB and 13SR are constructed integrally with the shock absorbing liner 13 by the customary foam molding procedures known in the art.

The helmet 10 may include the conventional elements utilized for cushioning purposes in the interior of the helmet. To this end, a cushioning pad 14 may be secured to and arranged centrally of the outer surface of the liner 13. Similarly, the conventional resilient sizing liner 15 may be secured to the shell 10 at the liner 13. The sizing liner 15 may include a covering for the ear areas of the shell 11 to cover the ears of the wearer that is most advantageously constructed of the same expanded polystyrene foam material as the sizing liner 15 proper. This material for covering the ear area of the shell 11 is identified in the drawing by the reference numeral 16.

The safety helmet 10, constructed and defined as disclosed hereinabove, has been found to be acceptable for satisfying the requirements that are presently in effect or the contemplated standards that will be effective in the very near future with regard to a commercially acceptable helmet and has thereby further advanced the state of the safety helmet art based on the teachings of my prior copending application referenced hereinabove.

What is claimed is:

1. A safety helmet comprising an outer shell shaped to be worn on the head of a user and constructed of a preselected lightweight material having a high flexural modulus for distributing an impact load, a shock absorbing liner including integral stiffening pads adapted to be carried by the shell, the stiffening pads being constructed and defined to cover the brow areas and rear areas of the shell when the helmet is worn on the head of the user and extending in contact with the inner wall of the shell at said edges, and a resilient shock dampening layer arranged between the inner wall of the shell and the outer surface of the shock absorbing liner and extending coextensively with the inner wall of the shell to said stiffening pads for the shock absorbing liner, the resilient layer and shock absorbing liner being arranged in a close friction fit with the inside wall of the shell, the resilient layer and shock absorbing layer being constructed and defined for coacting to absorb the impact energy transmitted through the outer shell and to release the stored energy after impact without any permanent deformation.

2. A safety helmet as defined in claim 1 wherein the resilient layer is characterized as having maximum recovery and viscous dampening properties to function for dampening and insulating impact energy and for maintaining a substantial majority of the stopping distance during multiple impacts.

3. A safety helmet as defined in claim 2 wherein the outer shell is constructed of a fiber glass reinforced plastic material.

4. A safety helmet as defined in claim 3 wherein the shock dampening layer is constructed of fine-celled flexible polyethylene foam material.

5. A safety helmet as defined in claim 4 wherein the shock liner is constructed of an expandible polystyrene.

6. A safety helmet as defined in claim 1 including a sizing liner having an expanded polystyrene foam material constructed and defined to cover the inner wall of the shell at the areas covering the ears of the user when the helmet is worn on the head of the user.

* * * * *